United States Patent [19]

Kay

[11] 4,242,778

[45] Jan. 6, 1981

[54] PRESS FIT INTELLIGENT FASTENERS FOR RANDOM OR LIGHTLY CONSTRAINED ASSEMBLY

[76] Inventor: Alan F. Kay, 67 Byron Rd., Weston, Mass. 02193

[21] Appl. No.: 928,297

[22] Filed: Jul. 26, 1978

[51] Int. Cl.[3] ..... A44B 19/00

[52] U.S. Cl. ..... 24/230 R; 24/217 R

[58] Field of Search ..... 24/230 A, 230 AL, 230 R, 24/211 M, 201 B, 73 M, 73 S; 70/346

[56] References Cited

U.S. PATENT DOCUMENTS

| | | | |
|---|---|---|---|
| 557,952 | 4/1896 | Bohannan | 70/346 |
| 885,267 | 4/1908 | Martel | 24/230 A |
| 1,166,417 | 12/1915 | Snyder | 24/217 |
| 1,493,479 | 5/1924 | Deatrick | 24/230 A |
| 2,947,053 | 8/1960 | Sanderson | 24/217 |
| 3,264,699 | 8/1966 | Knowlton | 24/217 X |
| 3,643,296 | 2/1972 | Kahn | 24/217 X |

*Primary Examiner*—Nile C. Byers, Jr.
*Attorney, Agent, or Firm*—David A. Rich

[57] ABSTRACT

Mating fasteners having a convex receiving surface and a concave inserting surface rotationally symmetrical about an insertion axis. A key code of annular projections and grooves is located in a plane normal to and concentric with the insertion axis. A locking mechanism engages the mating pieces only when in mating relation as determined by the key code. A planar embodiment is included. Easy and accurate assembly or connection becomes much less critical.

18 Claims, 16 Drawing Figures

PRESS FIT INTELLIGENT FASTENERS FOR RANDOM OR LIGHTLY CONSTRAINED ASSEMBLY

BACKGROUND OF THE INVENTION

The invention relates to fasteners and connectors that are readily assembled with ease, accuracy and key coded to insure uniquely respective connections. Prior art fasteners are not suitable, e.g., for random or lightly constrained assembly as required for random processes, robot assembly or assemblies made under adverse conditions. "Blind" assemblies are frequently required for oil wells, mines and other inaccessible locations.

In the growth processes described by molecular biology, proteins are formed in living cells by the stepwise addition of unique collections of atoms or radicals which fit the partially assembled molecule at the proper point in the proper orientation. In this fashion enormously complex and unique molecules are grown, each of which meets one of the thousands of different needs of the living organism. As another example of a similar process, it is now believed that the geometry of individual molecules of a gas determines its odor. Only molecules with a specific shape and size can geometrically fit into and thereby stimulate one of a number of different types of receptacles which comprise the olfactory organ of an animal. When one type of these receptors is stimulated, a signal is produced and interpreted by the brain of the animal as a unique odor. Such processes result from random motion and suggest a model for practical use in mechanical fastening.

Electrical and fluid connectors, e.g., designed for "quick disconnect" frequently require great care in alignment in order to effect a correct connection, particularly where multiple connections are involved with a single connector. Complex assemblies involving numerous subassemblies and parts are the bain of installers, consumers and end users. Uniquely defining each part or subassembly by a suitable key code, combined with ease and accuracy of alignment is a long felt need for which heretofore an adequate solution has not been proposed.

SUMMARY OF THE INVENTION

A fastener pair of the invention may be attached to objects that may be assembled together. The fastener pair includes a receiving fastener mating part affixed to one object and an inserting fastener part affixed to another mating object. The fastener parts may be affixed to the objects to be assembled by brazing, bolting, gluing, or any of many other mechanisms well-known in the art.

The fastener of the invention is adapted for ready insertion in the direction of an insertion axis by virtue of a monotonically decreasing aperture, in a receiving part producing a conical or concave surface rotationally symmetric about the insertion axis. The inserting part is complementary in that the insertion piece has a monotonically decreasing cross-section producing a conical or convex surface rotationally symmetric about the insertion axis. The minimum diameter of the inserting part is small relative to the diameter of the receiving opening aperture, enabling ready insertion and making the mating process permissive.

A portion of both the receiving and inserting mating parts have patterns of multiple annular projections and grooves providing key codes such that the fastener parts only lock onto or grab each other if their respective key code patterns, which may be any one of a large number, are complementary for mating. Unless the parts mate properly as determined by the key code, they are "forbidden" to mate. All fastener pairs used in a given assembly are generally identical except for the key codes. Thus, from among many receiving and inserting parts, only selected pairs mate with each other. In this sense the fastener is "intelligent."

The receiving fastener is very forgiving relative to the inserting motion of the inserting fastener, as a result of the structure characterized above and described in greater detail below. Given a force component tending to align the fastening pair along the insertion axis there is a wide latitude permitted with respect to the initial point of contact and the initial relative orientations of the objects to be fastened, readily enabling a successful connection limited only by the key code.

Consider two objects in a box. One object has an inserting fastener, the other a receiving fastener. The box is shaken vigorously for a reasonable time. The chance that the two objects fasten to each other by random motion is high, much higher, e.g., than for fastening with other common types of fasteners such as bolts, clips, snaps, screws or nails. Furthermore, if the keys do not mate and if the objects do not have reentrant shapes, sticky surfaces or other features which may cause them to lock to each other despite the key code, no motion can cause the objects to fix to each other; inadvertent locking or binding is eliminated. Simple rigid parts such as prisms, spheres, cylinders, cones, etc., with smooth wood, metal, or plastic surfaces and some subassemblies of such parts are examples of objects which meet this requirement. The design criteria of the fasteners themselves are such that nonmating fasteners do not bind, wedge, or otherwise cause the objects to stick to each other.

In the event that a fastener pair mate properly in accordance with the key code, a retainer coupled to one fastener attaches to the other to hold them together.

Permanent magnets may be included to enhance the mating process and proper alignment. The magnets may be annular or in polar pairs. The magnets may be included as part of the key code. By suitable choice of magnets the fasteners may be uniquely rotationally aligned about the insertion axis.

The invention will be further apparent from the following description taken in connection with the accompanying drawings, and its scope will be defined in the appended claims.

In the drawings:

FIG. 1 is an exploded view of a fastener pair in perspective showing a preferred embodiment of the invention, partially in section, particularly illustrating rotational symmetry;

FIG. 2 illustrates the key code; FIG. 2(*a*) is an end view of a key code element; FIG. 2(*b*) is a side view in section of a mating pair of key code elements, and FIG. 2(*c*) is a graph illustrating the variables defining a key code;

FIG. 9(*b*) is a side view of the part in FIG. 9 (*a*);

FIG. 10 (*b*) is a side view of fastener in 10 (*a*).

FIG. 10 (*c*) is a plan view of receiving fastener part mating with part shown in FIGS. 10 (*a*) and (*b*).

FIG. 10 (*d*) is a side view of part in FIG. 10 (*c*).

DESCRIPTION AND OPERATION OF THE FASTENER IN FIGS. 1-6

Figure 1:
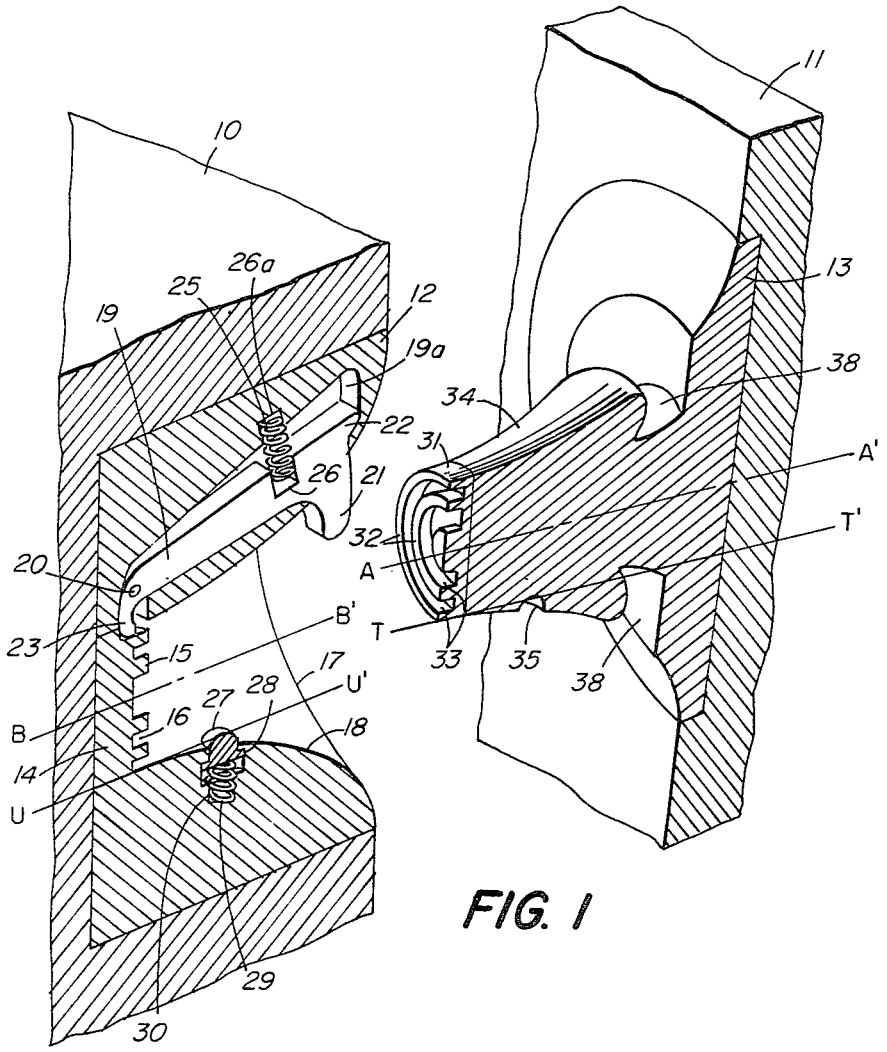
Figure 2A:
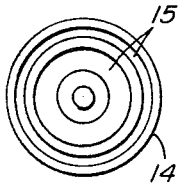
Figure 2B:
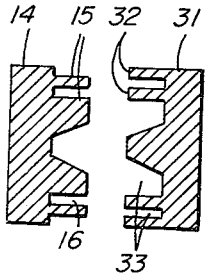
Figure 2C:
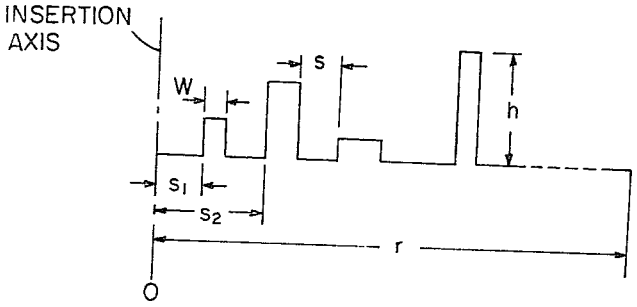

Referring now to the drawings and with particular reference to FIGS. 1 and 2, there is here illustrated a fastener pair embodying the invention.

A pair of objects, 10 and 11 shown fragmentary, have a fastener pair 12 and 13 integrally formed therewith. The inserting fastener part 13 is rotationally symmetric about an axis AA'. The receiving fastener 12 is rotationally symmetric about an insertion axis BB', except for retainers. The fastener 12 has a key code element 14 formed of annular ridges or projections 15 and grooves 16. A receiving aperture 17 monotonically decreases to form a surface 18 leading to a tangency relation with the element 14 parallel to the insertion axis BB'. A pivotal ratchet pawl 19 pivots about a bearing point 20 within a cavity 19(*a*) formed in the fastener part 12. When the inserting fastener 13 is mated with the receiving fastener 12, trigger 23 is forced away from the surface 18 to cause the ratchet arm 19 to force a pawl 21 into a complementary annular cavity 38 formed in the other fastener part. A knob 22 extends beyond the pawl 21. The pawl is held in place by a weak compression spring 25 which is engaged in a cavity 26 formed in the ratchet pawl 19. The other end of the spring 25 is engaged in a cavity 26(*a*) in the receiving fastener body. A retractable detent 27 is contained within a cavity 30. A spring 29 urges the detent 27 into the aperture 17. A flange 28 contains the detent within the cavity 30.

The fastener 13 has a key code element 31 having annular ridges 32 and grooves 33 forming a mating key code. As noted above, the annular pawl groove 38 is formed in the fastener 13 to receive the pawl 21. A surface 34 monotonically decreases toward the element 31 ending in tangency therewith. A cavity 35 receives the detent 27 for holding the fastener pair in fixed rotational position.

Figure 3:
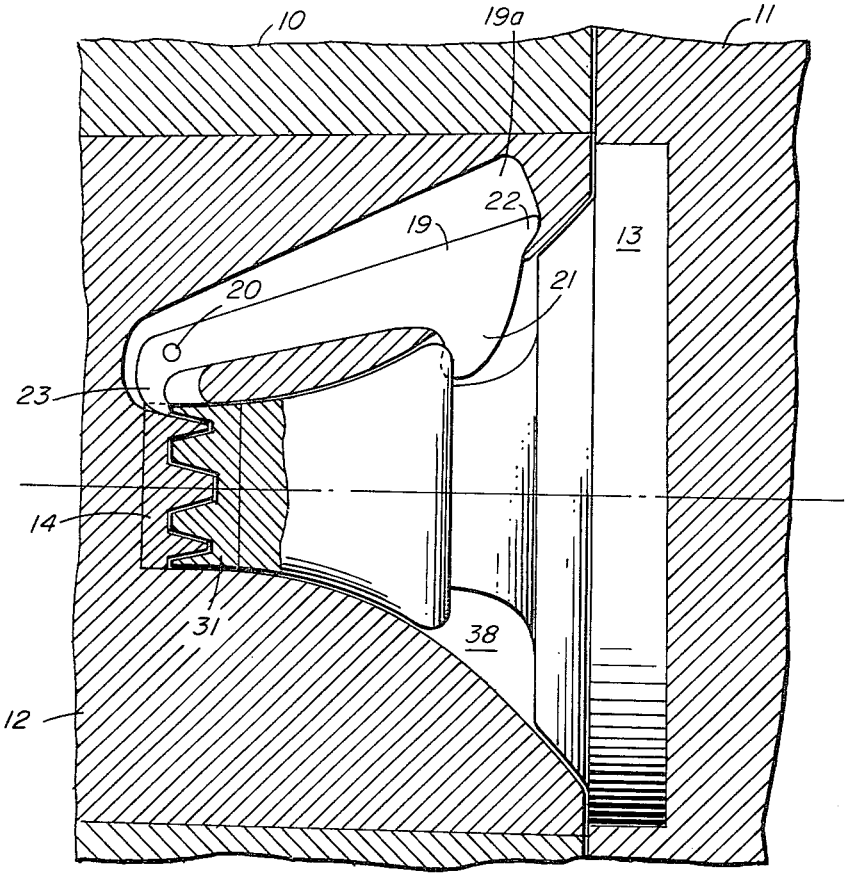
FIG. 3 is a partly schematic, side view, partly in section, illustrating the fastener pair of FIG. 1 showing the retractable ratchet pawl in place for a permanent connection.

In FIG. 2(*a*) an end view of the element 14 is shown. In FIG. 2(*b*) a side view in section of the elements 14 and 31 is shown. In FIG. 2(*c*) a schematic of the ridges and grooves is shown illustrating the variable parameters width W, height h and spacing s of the annular ridges and grooves whereby a large variety of key code patterns may be derived within the radius r of the element. The leading edge of the ridges relative to the insertion axis is indicated by $S_1$ and $S_2$. In FIG. 3 the pawl 21 is shown in the groove 38 when the fasteners 12 and 13 are properly mated and aligned along the insertion axis BB', spring 25 not shown.

Figure 4:
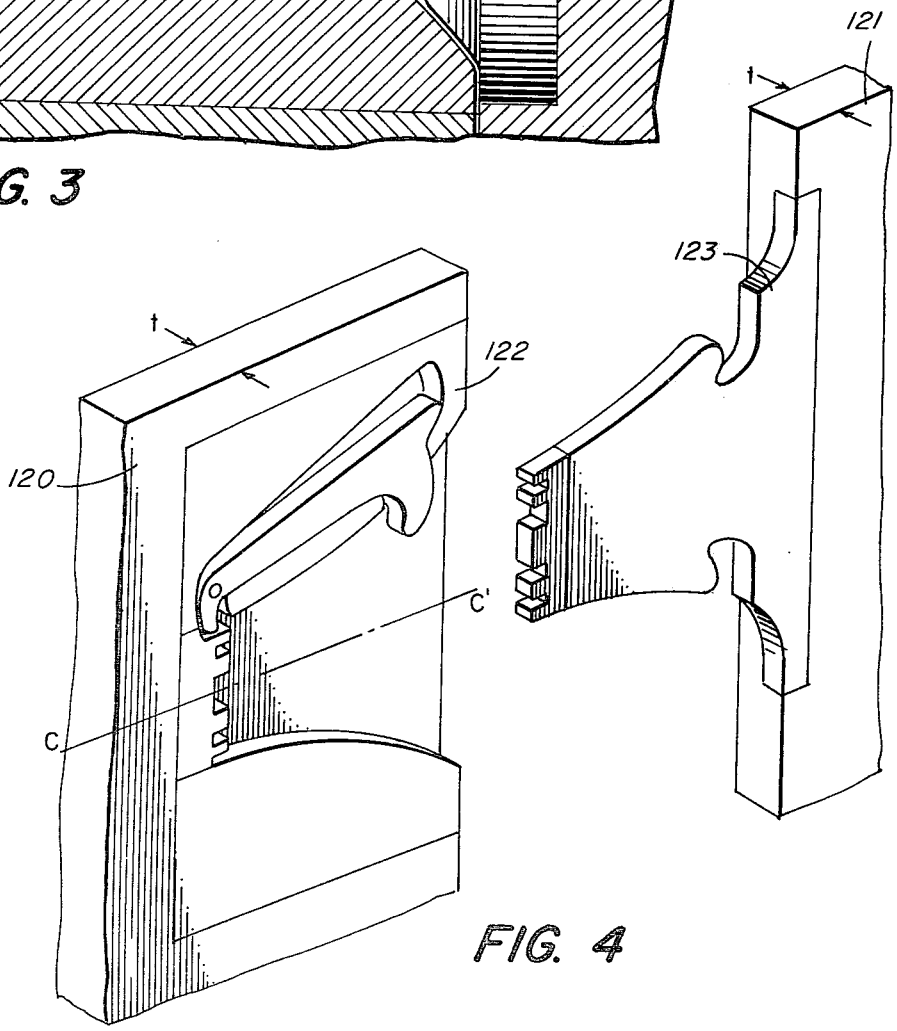
FIG. 4 is a perspective view of a planar modification of the fastener in FIG. 1.

In FIG. 4 the planar version shown applies to objects 120 and 121 having uniform thickness t. The fastener parts 122 and 123 are affixed to the objects within the thickness t and are confined in motion to a plane. Here there is symmetry with respect to the insertion axis CC' as shown.

OPERATION

Because of rotational symmetry, a successful fastening is independent of the rotations of the fasteners 12 and 13 with respect to the insertion axis. The surfaces 18 and 34 are smooth surfaces of revolution of small, slowly varying curvature in any axial plane, such as the sectional plane in FIG. 1. These surfaces act to guide the two parts together for a proper fit even if at the initial point of contact the axes AA' and BB' are linearly and angularly displaced. Preferably the surfaces 18 and 34 are concave/convex as shown with tangents, TT' and UU', at the key surfaces substantially parallel to the axes AA' and BB', respectively. In this case when the key surfaces first come in contact, as the fastener parts approach each other, they have been substantially aligned with respect to both linear and angular displacement. Thus, as the parts approach each other, whether or not they mate depends only on the key code.

The pawl 21 is so shaped, as shown, that if it happens to extend into the receiving cavity, upon contact with the incoming inserting fastener 13, the pawl is caused to withdraw into the cavity 19(*a*) overcoming the spring 25. The nob 22 on the pawl 21 keeps the pawl from extending so far into the receiving cavity that this action is inhibited.

As the two key surfaces 18 and 34 make first contact, if any portion of a ridge on one face faces a ridge on the other face, e.g., that is if the key patterns of the inserting and receiving parts forbid mating, the fastener pair is restrained from engaging and the pawl is not triggered to engage the ratchet groove. The fastener pair comes apart under very slight force. The fastener surfaces 18 and 34 should, of course, be smooth with a low coefficient of friction.

When the key grooves and ridges mate exactly, a small force acting to bring the fastener pair together is sufficient to close the final gap as shown in FIG. 3. In the process, the pawl 21 is pressed into the groove 38 in the inserting fastener 13 and the pawl by the action of rotation about the pin 20 firmly engages the ratchet groove 38. This locks the fastener pair together, each part still free to rotate about axis AA', BB'. Such a joint with one degree of rotational freedom may be desired in some applications, and in such cases no other retainer action is necessary.

However, if it is desired to fix the fastener pair together in rotational position relative to the insertion axis, an additional spring loaded shaped detent 27 on the receiving fastener 12 may engage a recess 35 in the other part of a suitable shape to accept the detent 27. The parts are rotated with respect to each other about AA' and BB', to engage in only one rotational position. It will be apparent that either the pawl or the detent may be on the insertion part and the corresponding groove or recess on the receiving part. It will be further apparent that the ratchet pawl may be used to restrain rotational motion or the detent and annular groove may be used to restrain axial motion. Both the ratchet pawl/groove and the detent/recess combinations may be so shaped that the attachment is either temporary or permanent. Temporary attachment means that the fastener parts may be separated without breaking.

Further a plurality of ratchet pawls and/or detents may be used in selected rotational position. There are, of course, a large number of other mechanisms well-known in the art to accomplish the same purposes.

Figure 5:
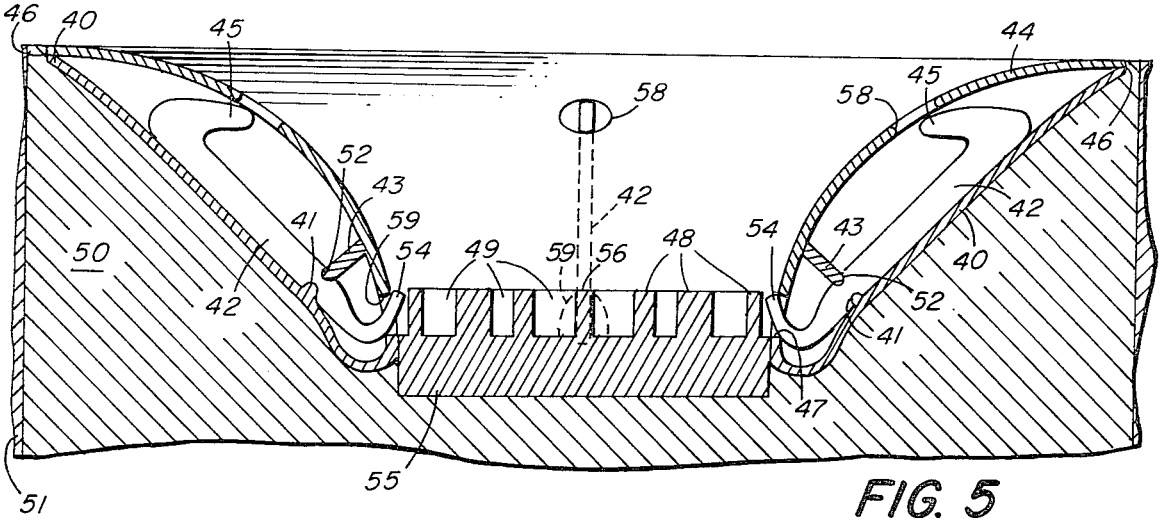
FIG. 5 is a side view partially in section of a variation of the receiving fastener part in FIG. 1.
Figure 6:
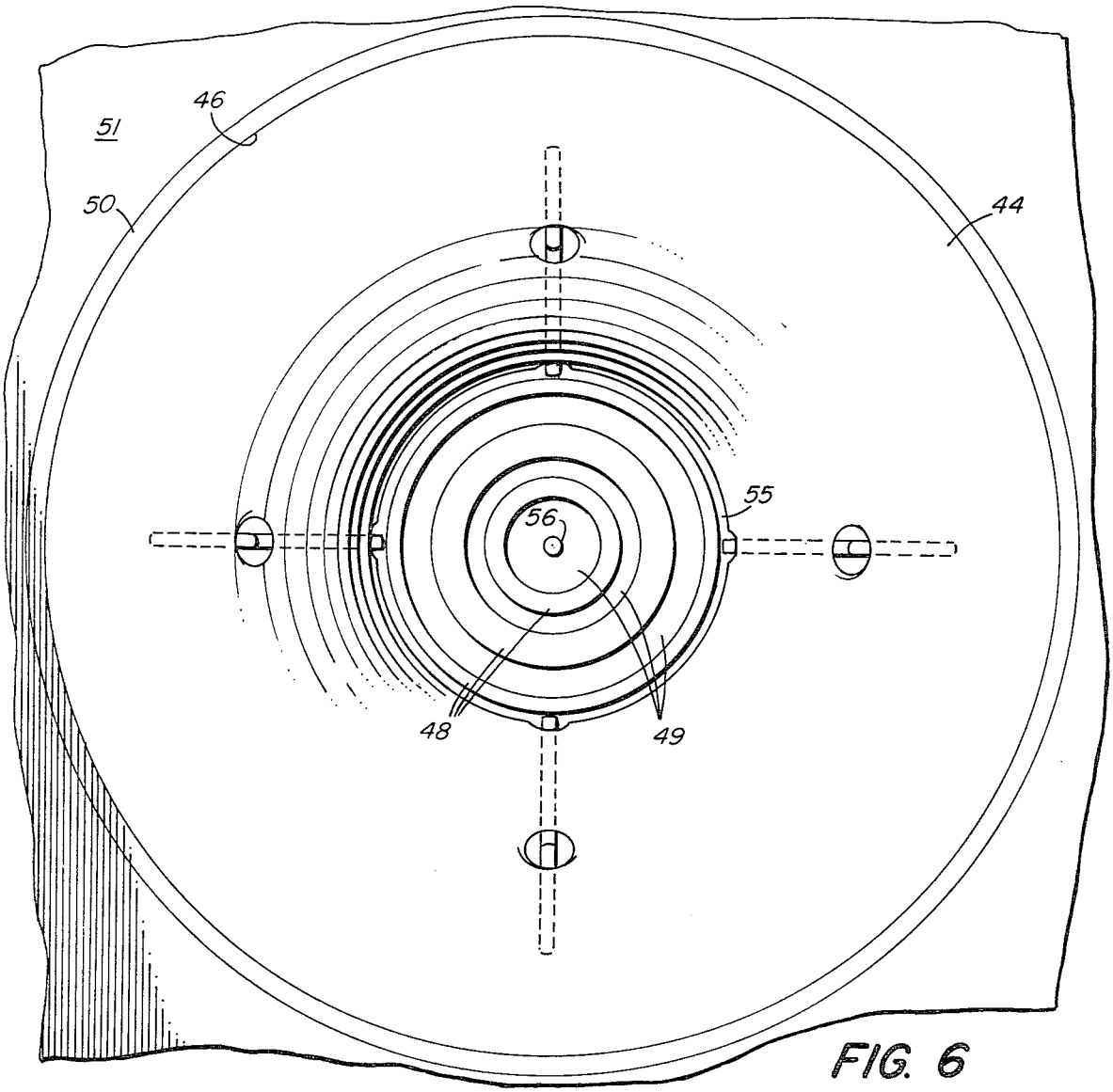
FIG. 6 is a plan view of the part in FIG. 5.

In FIGS. 5 & 6 four ratchet pawls 42 are illustrated in a receiving fastener part generally indicated at 50 affixed to an object 51. A shaped, substantially conical thin sheet 40 with a circular ridge 41 supports the four ratchet pawls 42 in assembly. A conical ring 43 fits in grooves 52 in the ratchet pawls 42. A concave shaped annular sheet forms a receiving surface 44. It is attached along a circle 46 to the sheet 40 and generally also contacts it along a circle 47. This thereby secures the ring 43 and the ratchet pawls 42 so that all parts are rigid except that each pawl 42 can rotate about a point near the ridge 41 by slightly flexing ridge 41 or ring 43 or both. In the unflexed condition, the pawl 45 extends into the receiving aperture. The flexing action eliminates the need for the spring 25 and bearing 20 of FIG. 1. The surface sheet 44 has a slot 58 and 59 for each pawl 45 and trigger 54, respectively, of each ratchet pawl 42. In this embodiment all parts are figures of revolution, except the ratchet pawls and their corresponding slots in sheet 44. The ratchet pawls are flat. A separate key code element 55 has a central pin 56 and annular ridges 48 and grooves 49.

KEY CODES

Assume the key code surface of radius r is divided into N rings each of width W and forming either a groove or a ridge, then:

$$NW=r$$

The elements 16 and 31 mate if and only if for each of the N positions no ridge on element 16 faces a ridge on element 31.

If t is the combined tolerance of fabrication and assembly, ridges must be $+0$, $-t$ and grooves $+t$, $-0$ if a designed-to-mate fastener succeeds in mating. On the other hand, if two key codes are forbidden to mate, then at least one point on a ridge on one must oppose one point on a ridge of the other. Since the two ridges can be misaligned or undersized by a total of 2t, restraining contact can be assured if $W \geqq 2t$. The maximum number N of ridges for fixed s, W, and h is then:

$$N=r/2t \tag{1}$$

The maximum number M of distinct patterns of ridge/groove combinations such that every receiving part mates with one and only one inserting part is $$M=\begin{cases} \dfrac{N!}{(N/2)!\,(N/2)!}, & N \text{ even} \\[2ex] \dfrac{N!}{\left(\dfrac{N-1}{2}\right)!\left(\dfrac{N+1}{2}\right)!}, & N \text{ odd} \end{cases} \tag{2}$$

Since the outer position on the inserting part is preferably fixed as either a ridge or a groove for all allowed patterns in order that the parts always properly engage, the maximum available number of locations is conservatively less than that given by equation (1) by one, or:

$$N=(r/2t)-1 \tag{3}$$

If N in equation (3) is substituted in equation (2), we obtain the maximum number of distinct patterns with unique mates for a given tolerance error and key face radius. The following table shows some values:

| r (t=.020") | r (t=.010") | N | M |
|---|---|---|---|
| .24" | .12" | 5 | 10 |
| .28 | .14 | 6 | 20 |
| .44 | .22 | 10 | 252 |

Thus, in this case, one can obtain an unlimited number of distinct key codes by increasing r or decreasing t, or both. In addition, it is apparent that varying the height h, width w and spacing s of the ridges and grooves may further increase the available number of patterns for a given r or t or both.

Two dimensional versions of the invention are also useful. In this case the fastener pair is flat as shown in FIG. 4, and the objects to be fastened are constrained to move in their own plane. For example, a number of flat pieces embodying the invention as fasteners may be placed at random in a large flat box and shaken, rotated or otherwise moved only in the plane of the pieces, the pieces ultimately assemble themselves correctly in a predesigned planar configuration.

Because of elimination of a variable third dimension, for a given number of parts, such random assemblies are more readily fastened together in the planar version.

FIGS. 7–10: USE OF MAGNETS AS RETAINERS AND TO INCREASE PROBABILITY OF BODIES APPROACHING PROPERLY FOR FASTENING.

Figure 7:
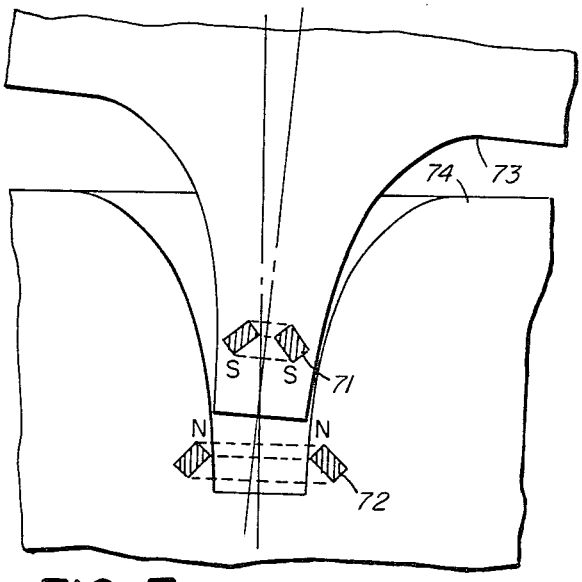
FIG. 7 is a sectional schematic view of a portion of the fastener in FIG. 1 modified to include annular permanent magnets to enhance mating and alignment.

If two small ring shaped permanent magnets are included in the inserting and receiving parts as shown in FIG. 7 with opposite poles facing, the force acting for proper alignment in the fastening motion is enhanced. If the key surfaces do not mate, the parts will not separate unless the disassembly force due to gravity, random shaking, or other means, exceeds the sum of the friction force and the magnetic attraction. However, if the key surfaces do mate, the magnets approach each other appreciably closer than in the non-mating case and add to the retaining force. If the retaining force in this case is greater than any forces occurring in the assembly process which act to break the contact, then these magnets can be used as retainers.

Again, the ring shape or axial symmetry of the magnets implies only one dimensional, i.e., axial, retention, which is appropriate for some applications.

A plurality of bar magnet pairs, polarized as shown in FIG. 7, may be used rotationally to position the fastener pair in one of a finite number of positions about the insertion axis.

Figure 8:
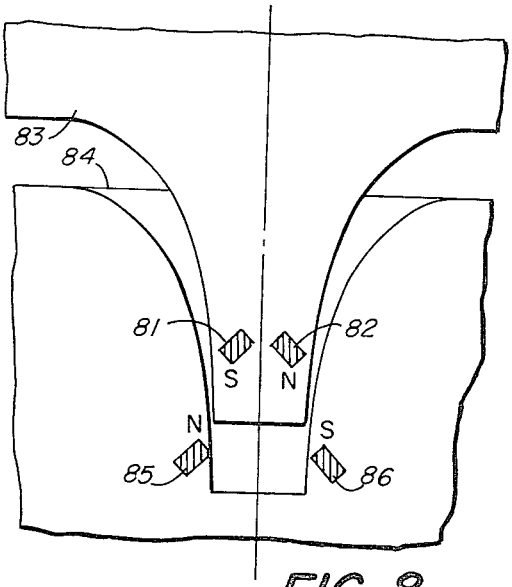
FIG. 8 is a sectional schematic view of the fastener in FIG. 5 modified to include two pairs of magnets to ensure rotational alignment.

If locking both axially and rotationally is required, two pairs of magnets as in FIG. 8 can be employed. Because of the switch in polarity on the second pair of magnets, a circumferential force field is set up to align the parts rotationally in a unique position.

Figure 9A:
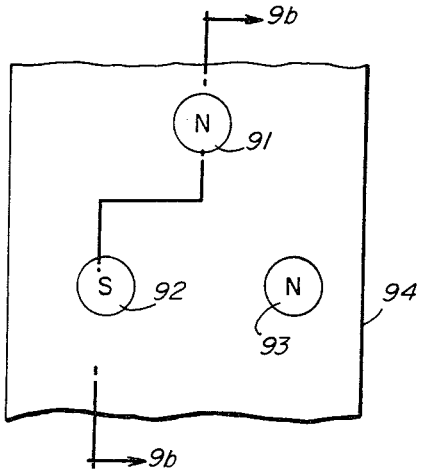
FIG. 9 (*a*) is a plan view of a fastener part, partially schematic, showing magnets in a key code pattern.
Figure 10A:
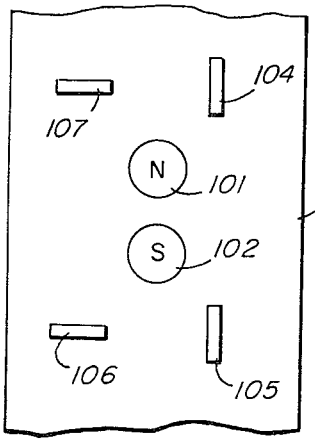
FIG. 10 (*a*) is a plan view of a modification of the inserting fastener part in FIG. 9.
Figure 10B:
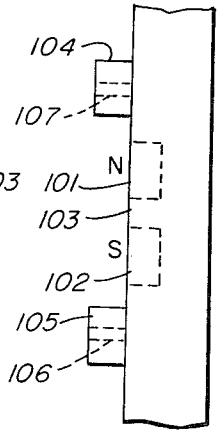
Figure 9B:
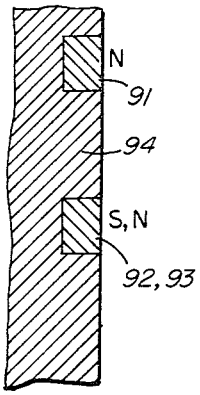
Figure 10C:
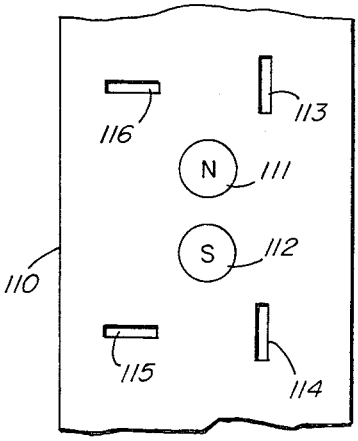
Figure 10D:
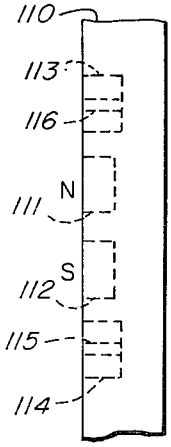

In some cases, magnets alone, either a pattern as shown in FIG. 9 or in conjunction with retaining pins as shown in FIG. 10 can be used eliminating the need for the shaped receiving cavity and inserting fastener part altogether.

Referring now to FIG. 7 there is here illustrated a pair of annular magnets 71 and 72, polarized as shown. The magnet 71 is enclosed in an inserting fastener part 73 and the magnet 72 is enclosed in a receiving fastener part 74. The details of the key code elements are not shown.

In FIG. 8 a pair of bar magnets 81 and 82 are enclosed in an inserting part 83. A pair of magnets 85 and 86 are enclosed in a receiving part 84. The magnets are polarized as shown to enhance axial and rotational alignment.

In the plan schematic view of FIG. 9 (*a*) a plurality of flush-mounted magnets 91, 92 and 93, polarized as shown, are shown mounted in a fastener part 94. In the side view of FIG. 9 (*b*) the magnets are shown in section. A complementary fastener part with magnets of a complementary polarity is not shown. The fastener parts mate in accordance with the magnet polarity pattern.

With reference to FIGS. 10(*a*) and 10(*b*), an inserting fastener part is shown with flush-mounted magnets and shaped retainer pins. The magnets 101 and 102 are flush mounted in the fastener part 103. The shaped pins 104–107 extend from the part 103 as shown in the side view of FIG. 10 (*b*).

A complementary receiving fastener part 110 has flush mounted magnets 111 and 112, polarized as shown, and shaped cavities 113–116 formed therein corresponding with the magnets 101, 102 and pins 104–107 as shown in the plan view of FIG. 10(*c*) and side view of FIG. 10(*d*).

The fastener parts mate in accordance with both the magnet polarity and retainer pin patterns.

APPLICATIONS

The fasteners may be used in a variety of ways including:

(a) Educational Demonstrations

The fasteners are attached to objects (representing atoms or radicals) such as plastic spheres or groups of spheres. A number of these parts are placed inside a box which is shaken vigorously, simulating the random motion of molecular formation made under heat or force field actions. The parts ultimately assemble themselves in ways that mimic molecular processes.

The process illustrates natural growth under various circumstances.

(b) Toys

The fasteners can be utilized with toys, such as blocks and construction parts, with maximum ease of assembly. These assembly toys can be correctly assembled by a child without instructions by trial and error, perhaps aided by color or other clues.

(c) Puzzles

The fasteners are attached to parts which can be assembled in only one way to ultimately create a two or three dimensional construction of geometrical, visual, or intellectual interest. Alternatively, the parts may have subsets of distinct fastener patterns so that, for example, if the parts are all either red, white and blue, they will only go together in the sequence red, white, blue, red, white, blue, red, white, blue, etc. The puzzle consists of trying to guess what the ultimate result of the construction will be. The final construction could spell out one or a series of messages, make one or more pictures, or work out to an intricate design, or a model of an object such as an airplane, ship, human figure, etc.

(d) Magic Trick

The ability to form from parts a construction which appears to be the work of "intelligence" when shown to an audience but was actually due to random or quasi-random forces acting on the parts can be made the basis of tricks for a magic show.

(e) Artistic Construction

If the ultimate construction based on the use of the fasteners of the invention has artistic merit, then these fasteners have application in two and three dimensional artistic construction.

(f) Robot Assembly

Tolerance problems often limit assembly applications performed by mechanical robots. Since the invention permits wide latitude in successful assembly motions, it may be used in robot assemblies.

(g) Assembly Without Instruction

In many fabricated part assembly situations, there are language or communication problems which preclude effective written assembly instructions. Since the fasteners can be designed so that only parts which should be assembled to each other will in fact assemble, they can be used without any written or verbal instructions.

(h) Assembly When Parts May Not Be Visible

In some situations, such as the placing or removing of pipe sections and other parts underground in oil and gas drilling and other mining activities, the parts are not readily visible or easily controlled and a certain amount of fishing or trial-and-error assembly activities are required. By judicious choice of the type and location of the fasteners, such parts may be more readily assembled with the chances of any two parts mating or jamming which should not mate or jam, much reduced. And two parts which should mate have a greater chance of doing so.

(i) Electrical and Fluid Connectors

For connectors involving a plurality of connections, accurate alignment is essential. The difficulty of aligning connectors is widely felt. Connectors in accordance with the invention greatly increase the margin for error with ready alignment and proper mating.

While there has hereinbefore been presented what are at present considered to be the preferred embodiments of the invention, it will be apparent that many modifications and changes may be made without departing from the scope and spirit of the invention. All such changes and modifications are considered, therefore, to be a part of this invention.

What is claimed is:

1. Fastening means, comprising:

a first mating element for receiving a second mating element in mating relation along an insertion axis, said first element having circular key code means formed in said first element in a plane perpendicular to said axis and rotationally symmetric about said axis, receiving surface means formed in said first element rotationally symmetric about said axis, said receiving surface providing a monotonically decreasing aperture directed toward said code means for receiving said second element, extensible locking means formed in said receiving surface means for locking said second mating element in place relative to said insertion axis only when said elements are in mating relation as determined by said code means;

a second mating element for insertion in said first mating element in mating relation along said insertion axis in the direction of said code means, said second element having second circular key code means formed in said second element in a plane normal to said axis and rotationally symmetric about said axis in mating relation to the first said code means, inserting surface means formed in said element rotationally symmetric about said axis, said inserting surface providing a monotonically decreasing projection directed toward said second code means for inserting into said first element, and engaging means formed in said inserting surface means for engaging said locking means in locking relation only when said elements are in mating relation as determined by said code means, whereby said second element may be introduced into said first element along an arbitrary axis and easily aligned with said insertion axis in mating relation and locked in place only as determined by said code means.

2. The fastening means of claim 1, wherein:

said code means include a plurality of annular projections.

3. The fastening means of claim 1, wherein said receiving surface is convex and inserting surface is concave.

4. The fastening means of claim 2, wherein:

the heights of said annular projections differ relative to each other.

5. The fastening means of claim 2, wherein:

the widths of said annular projections differ relative to each other.

6. The fastening means of claim 2, wherein:

the widths and heights of said annular projections differ relative to each other.

7. The fastener means of claim 1, wherein:

said locking means include racheted hammer locks and said engaging means include an annular groove.

8. The fastener means of claim 7, wherein:

said locking and engaging means are adapted for a permanent locking relation.

9. A receiving fastener means for receiving an inserting fastener mating means in mating relation along an insertion axis, comprising:

(A) a receiving fastener body;

(B) circular key code means formed in said body in a plane perpendicular to said axis and rotationally symmetric about said axis;

(C) receiving surface means formed in said body rotationally symmetric about said axis, said receiving surface providing a monotonically decreasing aperture directed toward said code means for receiving said inserting fastener means; and (D) locking means formed in said receiving surface for locking said inserting means in place relative to said insertion axis only when said fastener means are in mating relation as determined by said code means;

whereby said inserting mating means may be introduced into said receiving mating means along an arbitrary axis and easily aligned with said insertion axis in mating relation and locked in place only as determined by said code means.

10. The fastener of claim 9, wherein:

said code means include a plurality of annular projections.

11. The fastener of claim 10, wherein:

the heights of at least two said projections differ from each other.

12. The fastener of claim 10, wherein:

the widths of at least two said projections differ from each other.

13. The fastener of claim 11, wherein:

the widths of at least two said projections differ from each other.

14. An inserting fastener mating means for inserting into a receiving fastener mating means in mating relation along an insertion axis, comprising:

(A) an inserting fastener body;

(B) circular key code means formed in said body in a plane perpendicular to said axis and rotationally symmetric about said axis;

(C) inserting surface means providing a monotonically decreasing projection directed toward said code means for insertion into said receiving means; and (D) engaging means for engaging said receiving means in locking relation only when said mating means are in mating relation as determined by said code means;

whereby said inserting means may be introduced into said receiving means along an arbitrary axis and easily aligned with said insertion axis in mating relation and locked in place only as determined by said code means.

15. The fastener of claim 14, wherein:

said code means include a plurality of annular projections.

16. The fastener of claim 15, wherein:

the heights of at least two said projections differ from each other.

17. The fastener of claim 15, wherein:

the widths of at least two said projections differ from each other.

18. The fastener of claim 16, wherein:

the widths of at least two said projections differ from each other.

* * * * *